United States Patent [19]

Moore

[11] Patent Number: 4,765,350

[45] Date of Patent: Aug. 23, 1988

[54] ARTIFICIAL FINGERNAIL SCULPTURING SLIPPER DEVICE

[76] Inventor: Mary R. Moore, 7186 Font Ave., Riverside, Calif. 92509

[21] Appl. No.: 848,220

[22] Filed: Apr. 4, 1986

[51] Int. Cl.[4] ..... A45D 29/00

[52] U.S. Cl. ..... 132/88.5; 132/73; 132/76.4

[58] Field of Search ..... 132/73, 88.5, 88.7, 132/76.4, 76.5

[56] References Cited

U.S. PATENT DOCUMENTS

| | | | |
|---|---|---|---|
| 1,002,468 | 9/1911 | Strangman | 132/76.4 X |
| 1,040,446 | 10/1912 | Smith . | |
| 1,289,952 | 12/1918 | Struble . | |
| 1,434,442 | 11/1922 | Kohn et al. . | |
| 1,589,339 | 6/1926 | Goldman . | |
| 1,856,854 | 7/1931 | Schwanhausser . | |
| 1,888,218 | 11/1932 | Bynum | 132/76.5 |
| 1,956,627 | 5/1934 | Roth . | |
| 2,472,667 | 6/1949 | Lessard . | |
| 2,479,514 | 8/1949 | Rucker | 132/76.4 X |
| 2,513,208 | 6/1950 | Rogers | 132/73 |
| 4,034,769 | 7/1977 | Nishimura | 132/76.4 |
| 4,559,957 | 12/1985 | Hokama | 132/73 |
| 4,643,207 | 2/1987 | Grahame | 132/76.4 X |
| 4,648,416 | 3/1987 | Kilman et al. | 132/76.5 X |
| 4,683,897 | 8/1987 | McBride | 132/73 |

*Primary Examiner*—Randolph A. Reese
*Assistant Examiner*—Anthony Knight
*Attorney, Agent, or Firm*—Banner, Birch, McKie & Beckett

[57] ABSTRACT

An improved device for sculpturing artificial nails is disclosed. It comprises a handle, a contiguous concave foot portion and concave-convex shoe portions for removably fitting within the foot portion. Various shoe elements have various textured concave working surfaces which operate on the artificial nails. The concave shoe elements closely conform to the surface of the nail and eliminate trauma to the fingers caused by sculpturing nails.

10 Claims, 2 Drawing Sheets

ARTIFICIAL FINGERNAIL SCULPTURING SLIPPER DEVICE

TECHNICAL FIELD

The present invention relates to a device used during the sculpturing of artificially built nails. More particularly, the present invention relates to an improved device for preparing nails for sculpturing and for filing and shaping artificially built nails after an artificial nail substance has been applied to and has hardened on the natural nail.

BACKGROUND OF THE INVENTION

Artificial fingernails are placed on human nails for various reasons and purposes. The most common use is by women to enhance the attractiveness of their hands by displaying uniformly long and uniformly shaped fingernails. One type of artificial fingernail involves buiding up on acrylic fingernail on top of the natural nail. A built up or porcelain artificial nail kit typically includes a powdered acrylic polymer, a liquid acrylic monomer and a set of adhesively backed paper forms shaped to approximate a nail extension. Various files, drills and other implements are required to build up artificial fingernails.

In the practice of building up artificial nails, first the natural nails are filed with a fine nail file (e.g., emery board) in order to roughen the nail surface and to remove the nail's natural oil. This improves adhesion. Then, a paper form, which serves as a base support for the artificial nail, is disposed beneath each natural nail to extend beyond the end of the natural nail. The polymer and monomer are mixed together and applied to each natural nail and the projecting portion of the form. The polymer-monomer mixture forms extensions of uneven thickness and length. After the desired thickness is achieved and the mixture dries, the paper form is removed from under each nail. Upon removing the form, the artificially built nails cover the natural nails and extend to approximately the desired nail length. The artificial nails must then be shaped.

Shaping involves three steps. First, each artificial nail is generally shaped using a coarse nail file or a mechanical drill with a coarse sander bit. In using a drill, the side of the bit must be used to shape the nail. Second, the artificial nail is more precisely shaped using a fine nail file or a mechanical drill with a fine sander bit. Finally, the artificial nail is smoothed and shined using a buff pad. After buffing, the artificial nails are polished.

Maintaining artificial fingernails requires filing in new nail growth between the cuticle and the sculptured nail. First, any remaining polish is removed. Next, portions of the artificial nail which separated from the natural nail are removed with clippers. A coarse nail file is then used to smooth high points on the nail. Finally, an artificial nail is built up in the new growth area as previously described.

Nail care tools known in the prior art predominantly relate to the manicuring care of natural nails. Such tools are universally used on artifically built nails. These tools do not adequately meet the distinct needs of artificial nail sculpturing. The shape of natural nails and, therefore, the desired shape of artificial nails, is curved. The nail curves perpendicular to the longitudinal axis of the finger, presenting its convex surface outward. The nail also curves along the longitudinal axis of the finger, although this curve is less pronounced.

Prior art files, emery boards and other manual implements used for filing all comprise flat operational surfaces. They are designed primarily for use in manicuring, filing and shaping the ends of natural nails. In using such a manicuring device for shaping artificial nails, the file is translated back and forth over the surface of the artificial nail, often in a direction perpendicular to the finger being worked on. Using such a flat surface to shape, sculpt and approximate the curved surface of a nail yields imprecise results. Moreover, it is very difficult to properly file the sides of the nail as the skin and flesh of the finger interfere. As a result, parts of the finger are often traumatized by the file action. The skin is cut, abraded and burned.

It is also common practice to shape artificial nails by using electric grinders and drills with sanding bits of various grades. The sides of the bits are placed against the surface of the nail in order to file and sculpt it. Although this method is quicker than using manual tools, it has the same problems associated with manually operated files. It is difficult to properly shape the curved surface of the nail because the nail surface is convex and the working surface of the rotating sander does not compensate for this shape. Also, the finger is frequently injured. During operation, the drill often slips off the nail surface and abrades the finger due to the rotational momentum of the bit. In addition, the fingers are often burned due to the large amount of heat produced by the rotating bit.

Known buff pads are usually much larger than a finger nail and often have a convex shape to their working surface. Such a shape is, like the drill sanders, inconsistent with that of the fingernail. This results in uneven and inefficient application as the finger is buffed along with the fingernail.

Prior art sculpturing tools are inadequate. They often cause pain and trauma resulting from cuts, abrasions and burns. Moreover, they are inefficient and do not properly treat the sides of fingernails since they do not compensate for the curvature of the fingernails. This necessitates frequent reshaping of the nail. In addition, some states have enacted laws requiring professional manicurists to use disposable tools such as nail files. A new file must be used for each customer and thrown away after each use. This is costly and wasteful.

SUMMARY OF THE INVENTION

The present invention is directed to a device for use in sculpturing and shaping artificially built nails. The invention comprises a long slender handle made of aluminum and a widened foot portion attached thereto. The foot portion is shaped to conform to the shape of a fingernail and has a concave lower surface such that its arcs of concavity are greater than the arcs of a fingernail. This eliminates trauma and more uniformly shapes the nail. The foot portion may be provided with a textured working surface on its concave side or, in the preferred embodiment, the instrument is provided with a set of removable, disposable shoes or slippers which can be easily attached to the foot portion. These shoes are shaped to fit on the concave underside of the foot portion, the working surface of each shoe having the same concavity as the foot portion. Each shoe comprises one of four working surfaces: a coarse grade file, a fine grade file, a buff pad and a glossy surface. These surfaces are used to shape and sculpt artificial nails after they have been built up on the natural nails as described above.

The present invention overcomes the many disadvantages of prior art devices. It is shaped to fit on the surface of natural and artificial nails. In operation, the working surface does not contact the surrounding tissue. It is capable of properly shaping around the cuticle and it properly shapes the side of the nail as well as the top of the nail. It does not injure the fingers, thereby allowing the wearer of attractive artificial fingernails to also display attractive nontraumatized fingers. Because the shoe portions are removable and disposable, the device is cheaper to use and there is much less waste. Only the small shoe element need be thrown away and the handle may be reused. The aluminum handle is light, durable and may be readily sterilized by simply placing it in a container of sterilizing solution, such as alcohol. It is also easier and quicker for a professional manicurist to create built up artificial nails using the sculpturing slipper, especially in states where the law requires disposing of certain implements after each use. Instead of opening sanitarily sealed utensils and throwing away used utensils the manicurist merely peels off one pad and places another one on the handle.

For a beter understanding of the invention and its advantages, reference should be made to the accompanying drawings and descriptive matter which illustrate and described preferred embodiments of the invention.

DETAILED DESCRIPTION OF PREFERRED EMBODIMENTS

Figure 1:
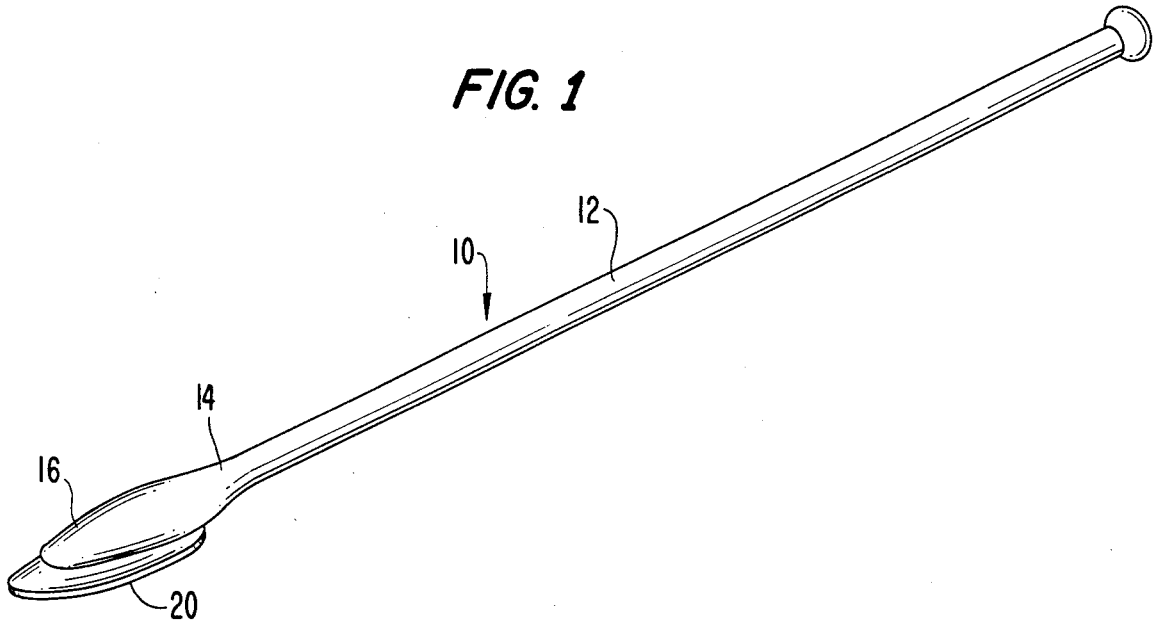
FIG. 1 is a perspective view of the artificial fingernail sculpturing device in accordance with the present invention, shown without the shoe portion.
Figure 2:
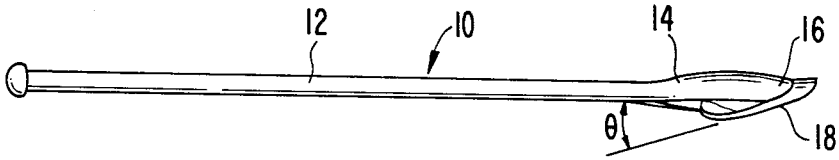
FIG. 2 is a side view of the artificial fingernail sculpturing device shown in FIG. 1.
Figure 3:
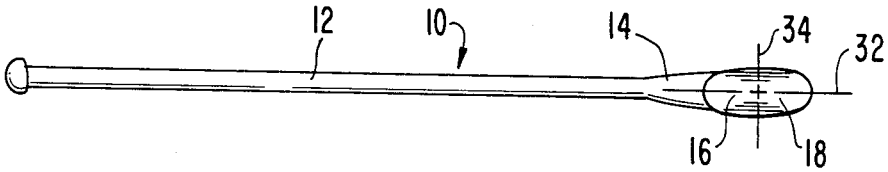
FIG. 3 is a bottom view of the artificial fingernail sculpturing device shown in FIG. 1.

Referring to the drawings in detail, wherein like numerals indicate like elements, FIGS. 1, 2 and 3 show a preferred embodiment of a device according to the present invention. The artificial fingernail sculpturing device is shown generally at 10. The device comprises straight elongated handle or leg member 12, foot portion 16 having concave underside surface 18 and ankle portion 14 which connects foot portion 16 to leg member 12. The device is preferably formed of aluminum to minimize its weight while maintaining durability. Other materials such as metals, wood, plastics and other substances are also suitable materials. As shown in FIG. 3, concave underside surface 18 of foot portion 16 is oblong and has a major axis 32 and a minor axis 34. Removable shoe element 20 is attached to concave underside surface 18 of foot portion 16.

As shown in FIGS. 4–7, shoe portion 20 is oblong, having a major axis 32 and a minor axis 34. It is also concave-convex having convex surface 28 and concave surface 30. Shoe element 20 is designed to fit removably on foot portion 16 in a complementary manner. Its convex surface 28 nests against concave underside surface 18 of foot portion 16. When shoe element 20 is attached to foot portion 16, their respective major and minor axes coincide. Major axis 32 forms an angle $\theta$ with leg member 12. In the preferred embodiment, $\theta$ is the range of 10°–40°.

Figure 4:
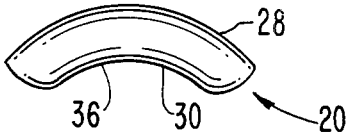
FIG. 4 is a front view of the removable shoe portion of the device.
Figure 5:
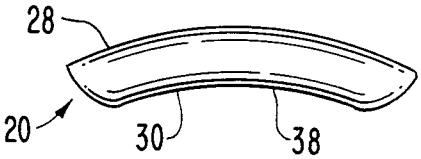
FIG. 5 is a side view of the removable shoe portion of the device.

Foot portion 16 and shoe element 20 both have concave surfaces 18 and 30, respecively. As seen in FIGS. 4 and 5, concave surface 30 of shoe portion 20, as well as the identical concave surface 18 of foot portion 16, is not circular. It comprises two transverse arcs 36 and 38. Arc 36 is substantially perpendicular to major axis 32 and substantially parallel to minor axis 34. Arc 38 is substantially parallel to major axis 32 and substantially perpendicular to minor axis 34. Arc 36 has a greater curvature than arc 38; the radius forming arc 36 is shorter than the radius forming arc 38. This working surface contour permits the fingernail sculpturing device to conveniently fit on, and conform to, the entire surface of the subject nail. This results in the advantages discussed previously.

Figure 6:
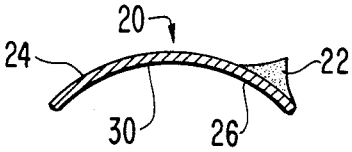
FIG. 6 is a front sectional view of the removable shoe element of the device.
Figure 7:
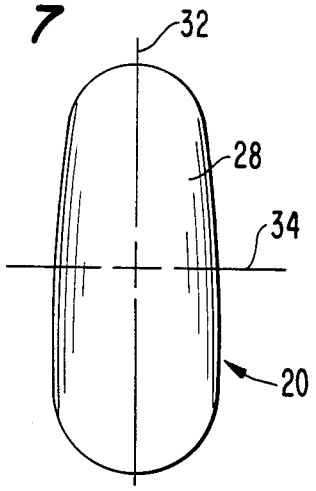
FIG. 7 is a top view of the removable shoe portion of the sculpturing device.
Figure 8:
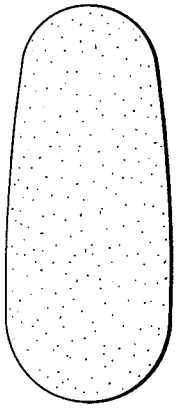
FIG. 8 is a bottom view of the removable shoe portion of the sculpturing device having a fine grade abrasive surface.
Figure 9:
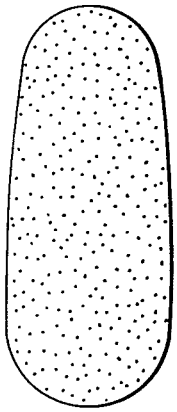
FIG. 9 is a bottom view of the removable shoe portion of the sculpturing device having a coarse grade abrasive surface.
Figure 10:
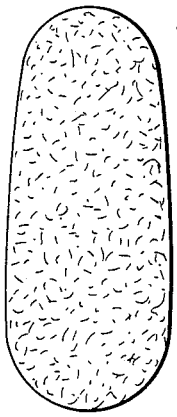
FIG. 10 is a bottom view of the removable shoe portion of the sculpturing device having a buff surface.
Figure 11:
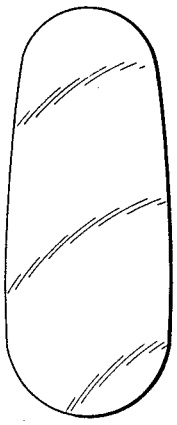
FIG. 11 is a bottom view of the removable shoe portion of the sculpturing device having a glossy surface.

As shown in FIG. 6, shoe element 20 further comprises a peel off adhesive layer 22, a backing 24 and a textured operating surface 26. Peel off adhesive layer 22 is used to removably fasten shoe element 20 to foot portion 16. Backing 24 semirigidly supports textured operating surface 26. Surface 26 contacts the nails during use of the fingernail slipper. Various textures, such as a fine grade abrasive surface, a coarse grade abrasive surface, a buff surface, and a glossy surface, illustrated in FIGS. 8, 9, 10, and 11, respectively, of textured operating surface 26 as shown in FIGS. 8–11, may be used during the operating process discussed above.

In an alternative embodiment, the underside of the foot portion 16 has a flat contour and each shoe portion 20 has the desired concavity on its underside.

The fingernail slipper could also be used to shape and remove any excess nail substance from underneath the fingernail by placing shoe element 20 on the top surface of foot portion 16 with textured surface 26 facing upward.

The sculpturing slipper is used in the following manner during the artificial nail creating process discussed above. The fine grade shoe is used to roughen the natural fingernail and the coarse grade shoe is used to generally shape the hardened artificial nail. Then the fine grade shoe is used to more precisely shape the fingernail. Finally, the buff shoe is used to smooth and shine the nail. The present invention can also be used to fill in new nail growth between the cuticle and the sculptured nail.

In operation, the working surface of the fingernail slipper is placed on the surface of the artificial nail. Due to the curvature of the working surface, the device will be able to be easily placed on the fingernail such that the major axis of the working surface aligned with the longitudinal axis of the finger and its forward-most portion will rest against the culticle. The fingernail slipper is then translated across the surface of the nail in a direction parallel to the major axis.

The glossy shoe can be used as a glue spreader in a further technique known in the art as a "nail wrap" process. According to this technique, glue is placed on the natural nail by an applicator and it is spread evenly and neatly by the glossy slipper. The particular contour of the shoe aids in preventing glue from contacting the finger. The glossy shoe may be formed of cellophane.

Numerous characteristics, advantages and embodiments of the invention have been described in detail of the foregoing description with reference to the accompanying drawings. The disclosure, however, is illustrative only and it is to be understood that the invention is not limited to the precise illustrated embodiments. Various changes and modifications may be effected therein by one skilled in the art without departing from the scope or spirit of the invention.

I claim:

1. A device for shaping sculptured nails comprising:

an elongated leg member; and a concave oblong foot portion contiguous with said leg member at one end of said leg member, said concave oblong foot portion having a working surface shaped to conform to the shape of a fingernail and having a major axis extending in substantially the same direction as said leg member and having a first cross-sectional arc substantially perpendicular to said major axis and a second cross-sectional arc substantially parallel to said major axis, said first cross-sectional arc having a smaller diameter than said second cross-sectional arc.

2. The device as set forth in claim 1 wherein said working surface is textured.

3. A device for shaping sculptured nails comprising:

an elongated leg member;

a foot portion contiguous with said leg member at one end of said leg member; and a shoe element with an upper portion shaped to removably fit on said foot portion, said shoe element having a concave oblong lower surface, said concave oblong lower surface being shaped to conform to the shape of a fingernail and having a major axis extending in substantially the same direction as said leg member and having a first cross-sectional arc substantially perpendicular to said major axis and a second cross-sectional arc substantially parallel to said major axis, said first cross-sectional arc having a smaller diameter than said second cross-sectional arc, said concave oblong lower surface comprising a textured working surface.

4. A device for shaping sculptured nails comprising:

an elongated leg member;

a concave oblong foot portion contiguous with said leg member at one end of said leg member, said concave oblong foot portion having a major axis extending in substantially the same direction as said leg member and having a first cross-sectional arc substantially perpendicular to said major axis and a second cross-sectional arc substantially parallel to said major axis, said first cross-sectional arc having a smaller diameter than said second cross-sectional arc;

a concave-convex shoe element shaped to removably fit on said concave oblong foot portion, said concave side of said concave-convex shoe element having substantially the same shape as said concave oblong foot portion and comprising a textured working surface; and fastening means for removably fastening said shoe element to said concave oblong foot portion on said convex side of said shoe element.

5. The device as set forth in claim 4 wherein said concave side of said concave-convex shoe element comprises a fine grade abrasive surface.

6. The device as set forth in claim 4 wherein said concave side of said concave-convex shoe element comprises a coarse grade abrasive surface.

7. The device as set forth in claim 4 wherein said concave side of said concave-convex shoe element comprises a buff surface.

8. The device as set forth in claim 4 wherein said concave side of said concave-convex shoe element comprises a glossy surface.

9. A device for shaping sculptured nails comprising:

an elongated leg member;

a concave oblong foot portion contiguous with said leg member at one end of said leg member, said concave oblong foot portion being shaped to conform to the shape of a fingernail and having a major axis extending in substantially the same direction as said leg member and having a first cross-sectional arc substantially perpendicular to said major axis and a second cross-sectional arc substantially parallel to said major axis, said first cross-sectional arc having a smaller diameter than said second cross-sectional arc; and a concave-convex shoe element shaped to removably fit on said concave oblong foot portion, said concave side of said concave-convex shoe element having a working surface having substantially the same shape as said concave oblong foot portion.

10. The device as set forth in claim 9 wherein said working surface is textured.

* * * * *